US006814551B2

(12) United States Patent
Kammhoff et al.

(10) Patent No.: US 6,814,551 B2
(45) Date of Patent: Nov. 9, 2004

(54) COMPRESSOR

(75) Inventors: Karl-Fr. Kammhoff, Weil der Stadt (DE); Friedhelm Ahrens, Karlsruhe (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 50 days.

(21) Appl. No.: 10/215,270

(22) Filed: Aug. 7, 2002

(65) Prior Publication Data

US 2003/0031570 A1 Feb. 13, 2003

Related U.S. Application Data

(63) Continuation of application No. PCT/EP01/14918, filed on Dec. 18, 2001.

(30) Foreign Application Priority Data

Dec. 22, 2000 (DE) ..... 100 65 821

(51) Int. Cl.[7] ..... F04B 17/00; F01C 1/02
(52) U.S. Cl. ..... 417/368; 417/366; 418/55.1
(58) Field of Search ..... 417/368, 371, 417/40.5, 366; 418/55.1, 55.4

(56) References Cited

U.S. PATENT DOCUMENTS

| | | | | |
|---|---|---|---|---|
| 5,240,391 A | * | 8/1993 | Ramshankar et al. | 417/410.1 |
| 5,395,214 A | * | 3/1995 | Kawahara et al. | 417/53 |
| 5,533,875 A | * | 7/1996 | Crum et al. | 417/368 |
| 5,772,411 A | | 6/1998 | Crum et al. | 417/368 |
| 6,000,917 A | * | 12/1999 | Smerud et al. | 417/368 |
| 6,017,204 A | | 1/2000 | Holzapfel et al. | 418/55.4 |
| 6,068,459 A | | 5/2000 | Clarke et al. | 418/55.4 |
| 6,074,141 A | * | 6/2000 | Ishikawa et al. | 409/132 |
| 6,074,185 A | | 6/2000 | Protos | 418/55.4 |
| 6,398,530 B1 | | 6/2002 | Hasemann | 418/55.5 |

FOREIGN PATENT DOCUMENTS

| | | |
|---|---|---|
| DE | 196 04 447 | 2/1997 |
| DE | 199 10 460 | 9/2000 |
| EP | 0 735 270 | 10/1996 |

OTHER PUBLICATIONS

*Patent Abstracts of Japan*, Abstract of Japanese Patent "Scroll–Type Fluid Machine", Publication No. 61250393, Nov. 7, 1986, Japanese Application No. 60091533, Filed Apr. 26, 1985.

*Patent Abstracts of Japan*, Abstract of Japan Patent "Scroll Type Hydraulic Unit", Publication No. 02196182, Aug. 2, 1990, Japanese Application No. 01015979, Filed Jan. 24, 1989.

*Patent Abstracts of Japan*, Abstract of Japanese Patent "Scroll Compressor", Publication No. 10220382, Aug. 18, 1998, Japanese Application No. 09022829, Filed Feb. 5, 1997.

* cited by examiner

*Primary Examiner*—Charles G. Freay
(74) *Attorney, Agent, or Firm*—Barry R. Lipsitz

(57) ABSTRACT

A compressor for refrigerant, comprising a housing and a scroll compressor including a first compressor body in a stationary position in the housing, and a second compressor body which can move relative to the first compressor body. A drive for the second compressor body has a drive motor. A rear-side cooling chamber is arranged between the rear side of the first compressor body and a partition of the housing, which runs at a spacing from the rear side. At least one aperture in the base of the first compressor body is configured to cool the first compressor body in the region of the rear side. The second compressor body is configured to enable the refrigerant to wash around the compressor body in the region of the rear side, remote from the scroll ribs, to cool the second compressor body.

36 Claims, 5 Drawing Sheets

R
2
RB
120
138
122
124
136
116
114
110
112
16
32
20
28
128
132
22
30
14
130
100
18
134
24
26
90
88
54
10
50
64
44
52
60
84
86
137
42
12
70
40
74
83
78
82
72
82
76
81
34
144
80
2

COMPRESSOR

The present disclosure relates to the subject matter disclosed in PCT application No. PCT/EP01/14918 of Dec. 18, 2001, which is incorporated herein by reference in its entirety and for all purposes.

BACKGROUND OF THE INVENTION

The invention relates to a compressor for refrigerant, comprising a housing, a scroll compressor, which is disposed in the housing and has a first compressor body, which is disposed in a stationary position in the housing, and a second compressor body, which can move relative to the first compressor body, each of these bodies having a base and respective first and second scroll ribs, which are formed, for example, in the form of an involute to a circle and/or an arc of a circle, which rise above the respective base and engage in one another in such a way that, during compression of the refrigerant, the second compressor body can be moved along an orbital path about a center axis with respect to the first compressor body, and a drive for the second compressor body, having a drive motor.

Compressors of this type are known from the prior art, for example DE 100 99 10 460.

In compressors of this type, there is a need to achieve the highest possible efficiency, in particular the lowest possible leakage, during compression of the refrigerant.

SUMMARY OF THE INVENTION

In the case of a compressor of the type described in the introduction, this object is achieved, in accordance with the invention, by the fact that the refrigerant which is to be compressed by the scroll compressor can wash around the two compressor bodies in the region of their rear side, which is remote from the scroll ribs, so that the compressor bodies can be cooled.

The advantage of the inventive solution is considered to be that it makes it possible for both compressor bodies to be cooled in the same way and therefore for at least a similar temperature distribution to be achieved in both compressor bodies, so that both compressor bodies have a similar thermal expansion, and therefore the low but not insignificant leakage which can be achieved by means of high manufacturing precision is not adversely affected by uneven temperature distributions and therefore different levels of thermal expansion, so that overall the efficiency of the scroll compressor is reduced as a result.

In this context, it is particularly advantageous if the refrigerant which is to be compressed can wash around the second compressor body in the region of the rear side, which is disposed opposite the second scroll rib, radially outside its driver receiving part, since refrigerant washing around the compressor body on its rear side ensures that this body is effectively cooled, and in particular cooling is ensured as close as possible to the regions of the compressor body in which most heat is introduced.

Furthermore, it is particularly advantageous if the refrigerant which is to be compressed can wash around the first compressor body in the region of a rear side, which is remote from the first scroll rib.

In this case too, it is particularly advantageous for the compressor body to be cooled via its rear side, in order once again to provide cooling as close as possible to the regions of the compressor body in which considerable amounts of heat are introduced, in particular through heated compressed refrigerant.

In order also to enable the scroll ribs to be cooled as efficiently as possible via the rear side of the compressor body, it is preferably provided that the rear surface of the respective compressor body is formed directly by a base which carries the respective scroll rib, so that the scroll ribs which are connected to the respective base are also cooled as efficiently as possible.

In particular, with a view to the most efficient conduction of heat possible, it is particularly advantageous if the rear side of the compressor body forms the rear side of a unitary part which includes the base and the scroll rib and, in particular in the region of the rear side, does not have any elements which are incorporated in or connected to, for example fitted onto, this part.

To improve the cooling of the compressor bodies still further, it is preferably provided that both compressor bodies can be cooled by the refrigerant which is to be compressed in the region of a peripheral side which is on the outer side with respect to the center axis.

In connection with the explanation of the cooling of the first compressor body in the region of its rear side, it has not been defined in more detail whether cooling takes place substantially over the entire rear side or only in partial regions of the rear side.

In particular, it has also not been specified in further detail to what extent the first compressor body is still fixed via the rear side.

A particularly favorable solution provides that the refrigerant which is to be compressed can wash around the first compressor body in the region of its rear side which lies outside a high-pressure connection.

This provides a particularly large area, namely the area which lies radially outside the high-pressure connection, for cooling of the first compressor body, the high-pressure connection also contributing, in particular at least in part, to fixing the first compressor body in the housing.

A solution which is particularly advantageous in design terms provides that a rear-side cooling chamber, through which the refrigerant which is to be compressed can wash, lies between the rear side of the first compressor body and a partition of the housing, which runs at a spacing from this rear side.

The rear-side cooling chamber may be formed in a very wide variety of ways. A particularly favorable solution provides for the rear-side cooling chamber to surround a mounting receiving part for the first compressor body, so that substantially the rear side of the compressor body, with the exception of the regions in which the mounting receiving part is active, can be cooled via the rear-side cooling chamber.

It is preferable for the mounting receiving part to be formed in such a way that the rear-side cooling chamber runs in the form of a ring around the mounting receiving part for the first compressor body.

In this context, it is particularly suitable if the high-pressure connection for the first compressor body is integrated into the mounting receiving part and therefore passes through this mounting receiving part.

Particularly efficient cooling of the first compressor body is achieved if the mounting receiving part can also be cooled via the rear-side cooling chamber, so that if heat is introduced into the mounting receiving part by the refrigerant emerging under high pressure, the mounting receiving part itself can be directly cooled, in order for this heat to be dissipated.

In connection with the previous explanation of the individual exemplary embodiments, emphasis has been placed primarily on the cooling of the compressor bodies via the rear side. The cooling of the compressor bodies can be improved still further by the fact that the rear-side cooling chamber merges into a peripheral-side cooling chamber which surrounds an outer periphery of the first compressor body.

In this case, it is preferable for the peripheral-side cooling chamber to surround not only the outer periphery of the first compressor body but also the outer periphery of the second compressor body.

A solution which is particularly advantageous in mechanical terms provides that the first compressor body is supported by outer support elements which lie radially outside the scroll ribs with respect to the center axis.

In this case, it is particularly advantageous if the peripheral-side cooling chamber runs around the outer support elements, and therefore cools the first compressor body via the outer support elements, in particular if the outer support elements are formed integrally on the first compressor body.

Thus far, no further statement has been made in connection with the cooling action of the refrigerant which is to be compressed and washes through the rear-side cooling chamber. By way of example, a particularly advantageous exemplary embodiment provides that the temperature of the surface, which borders the refrigerant which is to be compressed in the rear-side cooling chamber, of the first compressor body within an annular region which lies between approximately 50% and approximately 80%, preferably approximately 60% and approximately 70%, of a maximum radius of the scroll ribs is at most 8° centigrade, preferably at most 5° centigrade, higher than the temperature of the refrigerant which is to be compressed and reaches the second compressor body.

This relation shows that sufficient cooling of the first compressor body is possible even if refrigerant which is to be compressed washes sufficient thoroughly through the rear-side cooling chamber; this washing action may take place as a result of pressure fluctuations, turbulence or convection and does not necessarily require the refrigerant which is to be compressed to flow through the rear-side cooling chamber.

In connection with the above description of the individual exemplary embodiments, no further statements have been made with regard to the order in which the compressor bodies are cooled.

By way of example, a particularly advantageous exemplary embodiment provides that the refrigerant which is to be compressed washes around the second compressor body first of all and then around the first compressor body.

In principle, the refrigerant which is to be compressed could originate from any desired section of a cooling installation. It is particularly advantageous if the refrigerant which is used to cool the compressor bodies is the refrigerant which is to be sucked in by the scroll compressor.

It could be refrigerant which, after it has cooled the compressor bodies, also cools further units. A particularly advantageous embodiment provides that the refrigerant which is to be sucked in cools the compressor bodies substantially immediately before it enters an intake region of the scroll compressor.

This solution is advantageous if only for the reason that the refrigerant which is to be compressed and is to be fed to the scroll compressor in any case, immediately before it enters the intake region, can be used to cool the compressor bodies.

The solutions which have been described thus far have not provided any further details as to how the refrigerant which is to be compressed enters the scroll compressor. A particularly favorable solution provides that the refrigerant which is to be sucked in flows into the intake region of the scroll compressor at least in part from a peripheral side of the scroll compressor between the base of the first compressor body and the base of the second compressor body.

In particular, it is possible for the refrigerant which is to be sucked in to be guided in such a way that it flows into the intake region of the scroll compressor at least partially radially with respect to the center axis between the bases of the compressor bodies.

To achieve particularly efficient cooling of the rear-side cooling chamber, it has proven advantageous if the refrigerant which is to be compressed, at least in the form of a part-stream, flows with forced guidance through the rear-side cooling chamber, so that, as a result of the forced guidance of the part stream, sufficiently intensive washing through the rear-side cooling chamber is ensured under all operating conditions.

This can advantageously be achieved by the fact that the refrigerant which is to be sucked in flows into the intake region of the scroll compressor at least in part from the rear-side cooling chamber through at least one aperture in the base of the first compressor body.

The inevitable result of this is that at least a part stream of the refrigerant which is to be sucked in flows through at least a partial region of the rear-side cooling chamber and therefore the refrigerant which is to be compressed washes with sufficient intensity any regions of the rear-side cooling chamber through which there is no direct flow, as a result of turbulence, pressure fluctuations and/or convection, in order for these regions to be cooled.

An embodiment of the solution according to the invention which is particularly advantageous and in particular operates stably in all operating regions provides that all the refrigerant which is to be sucked in flows into the intake region of the scroll compressor through the rear-side cooling chamber and then through at least one aperture in the base of the first compressor body, so that this forced guidance of the refrigerant which is to be compressed ensures sufficiently intensive washing of the rear-side cooling chamber even at low volumetric flows.

Furthermore, if the refrigerant which is to be compressed is guided in this manner, there is a reduced risk of liquid refrigerant entering the intake region if the first compressor body is disposed above the second compressor body and in particular also above the drive.

In the compressor according to the invention, the drive motor usually also needs to be cooled. It could be cooled separately. However, an advantageous embodiment provides for the refrigerant which is to be compressed to cool the drive motor and the scroll compressor.

In order, in particular, to ensure that no liquid refrigerant enters the scroll compressor itself, in particular when the compressor is being started up, it is preferably provided that the refrigerant which is to be compressed cools the drive motor first of all and then cools the scroll compressor. As a result, it is easy to achieve sufficiently intensive heating of the refrigerant which is to be compressed before it enters the scroll compressor, in order to avoid liquid refrigerant in the scroll compressor.

No more detailed statements have been made concerning the flow through the drive motor. By way of example, an advantageous solution provides for the refrigerant which is to be compressed to cool the drive motor on the rotor side.

In addition or as an alternative to this, there is provision for the refrigerant which is to be compressed to cool the drive motor on the peripheral side.

Furthermore, the compressor according to the invention can be made particularly simple if the refrigerant which is to be compressed first of all flows around the second compressor body in the region of the rear side of the base thereof, in particular radially outside the support body, and then enters the intake region of the scroll compressor, since as a result the refrigerant which flows through the drive motor can be used to cool the second compressor body immediately after the drive motor.

Furthermore, it is preferably provided that the refrigerant which is to be compressed, before entering the intake region, flows around support elements of the scroll compressor which are on the radially outer side with respect to the center axis of the first scroll rib.

In connection with the description given thus far of the individual exemplary embodiments, no further statements have been made as to the sealing of the scroll rib. By way of example, an advantageous embodiment provides for the scroll ribs of one compressor body, on end sides which face the base of the other compressor body, to carry end-side seals which are fitted into grooves.

These end-side seals could be disposed immovably in the grooves. It is particularly advantageous if the end-side seals can move in the grooves, in the direction of the base of the other compressor body.

A particularly suitable embodiment provides that the end-side seals, under the action of the higher pressure in each case in the scroll compressor, can be moved in the direction of the base of in each case the other compressor body.

The end-side seals may be made from different materials. By way of example, it is known from the prior art to form the end-side seals from metal lamellae. A particularly advantageous solution provides for the end-side seals to be made from plastics.

It has proven particularly suitable for the end-side seals to be made from Teflon.

It is preferable to use a TefleR Teflon® compound comprising approximately 5% to approximately 20% of carbon and other strength-promoting additives.

Furthermore, in the compressor according to the invention it is preferable for a nonreturn valve, which prevents the refrigerant which is under high pressure from flowing back into the scroll compressor, to be associated with the high-pressure outlet.

In this case, it is preferable for the nonreturn valve to be formed in such a way that it has a seal seat which lies in the first compressor body.

An alternative solution provides that the nonreturn valve is disposed in a high-pressure chamber on a side of the partition which lies opposite the first compressor body.

Further features of the invention form the subject matter of the following description and of the drawing illustrating some exemplary embodiments.

DETAILED DESCRIPTION OF THE INVENTION

Figure 1:
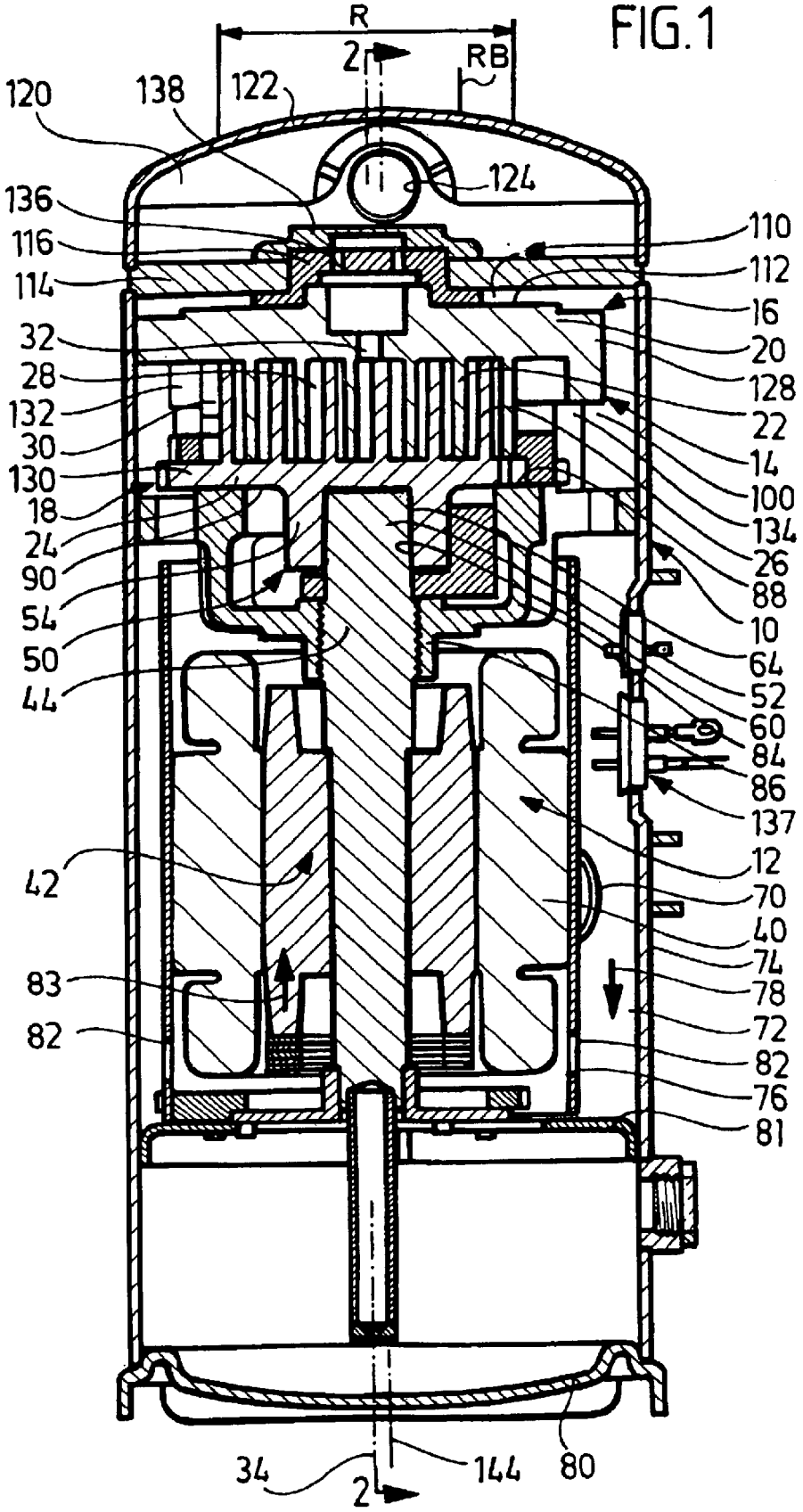
FIG. 1 shows a longitudinal section through a first exemplary embodiment of a compressor according to the invention.

A first exemplary embodiment of a scroll compressor according to the invention, illustrated in FIG. 1, comprises a housing, which is denoted overall by 10 and in which an electric drive motor, denoted overall by 12, and a scroll compressor, denoted overall by 14, are disposed.

The scroll compressor 14 comprises a first compressor body 16 and a second compressor body 18, the first compressor body 16 having a first scroll rib 22, which rises above a base 20 thereof and is formed in the shape of an involute to a circle, and the second compressor body 18 having a second scroll rib 26, which rises above a base 24 and is formed in the shape of an involute to a circle, the scroll ribs 22, 26 engaging in one another and in each case bearing in a sealing manner against the base 24 or 20, respectively, of in each case the other compressor body 18, 16, so that chambers 28 are formed between the scroll ribs 22, 26 and the base surfaces 20, 24 in which chambers a refrigerant, which flows in at an initial pressure via an intake region 30 which surrounds the scroll ribs 22, 26 on the radially outer side and, after compression in the chambers 28, emerges having been compressed to high pressure via an outlet 32 provided in the first compressor body 16, is compressed.

In the first exemplary embodiment described, the first compressor body 16 is held in a fixed position in the compressor housing 10, while the second compressor body 18 can be moved on an orbital path, around a center axis 34, relative to the first compressor body 16, the scroll ribs 22 and 26 theoretically bearing against one another along a contact line and the contact line likewise revolving around the center axis 34 during the movement of the second compressor body 18 along the orbital path.

The drive motor 12 for driving the second compressor body 18 comprises a stator 40, which is arranged in a fixed position in the housing 10, and a rotor 42, which sits on a drive shaft 44, which for its part is mounted rotatably, specifically about the center axis 34, in the housing 10.

To couple the rotary movement of the drive shaft 44 to the second compressor body 18, there is a driver unit, which is denoted overall by 50 and comprises an eccentric 52 which is formed as a driver and is disposed with an offset, specifically in the radial direction, with respect to the center axis 34.

The driver 52 engages in a driver receiving part 54, which is formed, for example, as a sleeve and is disposed at the base 24 of the second compressor 18, specifically on a side thereof which lies opposite the scroll rib 26, and faces toward the drive motor 12.

Figure 2:
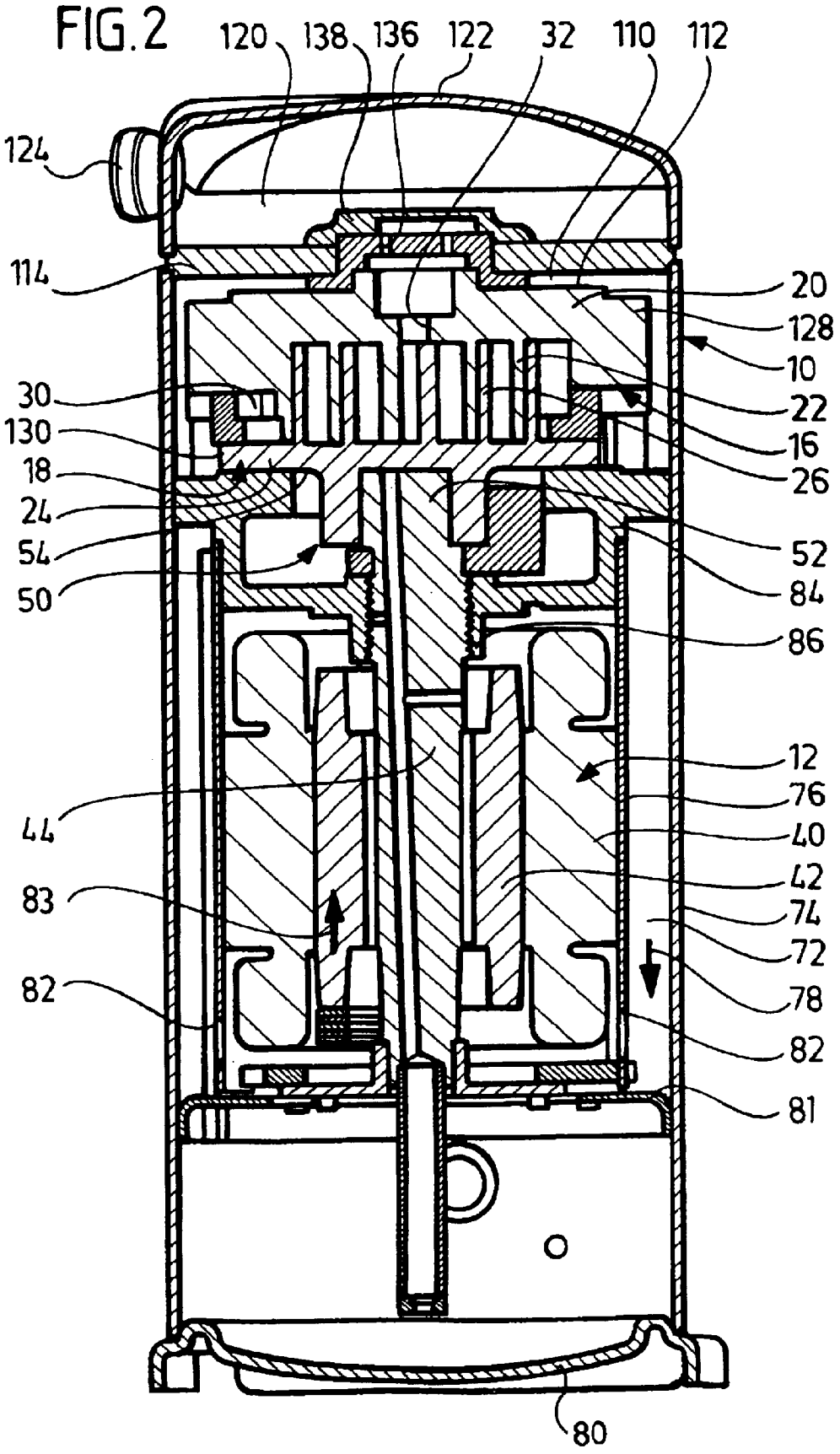
FIG. 2 shows a section on line 2—2 in FIG. 1.

As illustrated in FIG. 2, the driver receiving part 54, which is formed as a sleeve, has an inner cylinder surface 60, the cylinder axis of which on the one hand intersects the theoretically circular orbital path and on the other hand runs parallel to the center axis 34 but is arranged offset by the radius of the orbital path with respect to the center axis 34.

The driver 52, which is formed as an eccentric, is for its part likewise preferably formed as a cylindrical body with a cylindrical lateral surface 64, the cylinder axis of which likewise runs parallel to the center axis 34 and, furthermore, is at a radial distance therefrom which approximately corresponds to the radius of the orbital path.

According to the invention, the driver 52 is formed in such a way that, by means of a driver surface, it bears against the inner cylinder surface 60, which acts as a driver surface, of the driver receiving part 54 in a partial section, but otherwise runs without contact with respect to the driver surface 60, as described in DE 199 10 460, to the entire content of which reference is expressly made with regard to the structure and function of the driver unit.

To allow advantageous cooling of the compressor according to the invention, an inlet 70 for refrigerant which is to be compressed is provided in the housing 10, and specifically in the region of the driver motor 12, through which inlet the refrigerant which is to be compressed flows into an outer motor cooling chamber 72 which lies between an outer housing wall 74 and a shielding sleeve 76 which surrounds the drive motor 12.

From the outer motor cooling chamber 72, the refrigerant which is to be compressed flows in the direction 78 to a housing base 80 which is remote from the scroll compressor 14, but before it reaches the housing base 80 it is diverted radially inward by an intermediate base 81 and passes through passages 82 in the shielding sleeve 76 and then flows in direction 83 through the rotor 78, approximately parallel to the axis 34, until it reaches a carrying element 84, which on one side has a bearing sleeve 86 for the drive shaft 44 and on the other side has carrying surfaces 88, on which the second compressor element 18 rests by means of a rear side 90, which is on the opposite side from the second scroll rib 26, of the base 24 and is thereby supported in such a way that the second compressor body 18 is as a result prevented from moving away from the first compressor body 16.

The refrigerant which is to be sucked in preferably flows around the carrying element 84, during which process some of the refrigerant may also flow through the carrying element 84, and thus reaches the rear side 90 of the base 24 and is diverted radially outward thereby into an outer cooling chamber 100, which on one side is surrounded by the outer housing wall 74 and on the other side surrounds the scroll compressor 14 on the radially outer side.

This outer cooling chamber 100 is adjoined by a rear-side cooling chamber 110 which lies between a rear side 112 of the base 20 of the first compressor body 16 and a partition 114 fixed in the housing 10, the partition 114 carrying a mounting receiving part 116, by means of which a seal is produced between the pressure side and the suction side with respect to the first compressor body 16 in the region of the outlet 32 and by means of which the first compressor body 16 is also mounted, for example, on the partition 114.

For its part, the partition 114 extends transversely through the housing 10 and delimits a high-pressure chamber 120 which lies between a housing cover 122 and the partition 114, compressed refrigerant from the outlet 32 entering the high-pressure chamber 120 through the mounting receiving part 116, preferably by means of a flow in the direction of the axis 34.

Furthermore, the high-pressure chamber 120 is also provided with a high-pressure outlet 124, through which compressed refrigerant emerges from the high-pressure chamber 120.

The rear-side cooling chamber 110 surrounds the mounting receiving part 16 in the shape of a ring and, moreover is delimited on one side by the partition 14 and on the other side by the base 20 of the first compressor body 16, more than half the area of the rear side 112 of the base 20 bordering the rear-side cooling chamber 110, which runs radially outward with respect to the axis 34, all the way to the outer cooling chamber 100, and merges into the latter.

In the first exemplary embodiment, the refrigerant which is to be compressed enters the intake region 30 from the outer cooling chamber 100 by flowing in the radial direction from the outer cooling chamber 100, between an outer region 128 of the base 20 and an outer region 130 of the base 24, into the intake region 30, which lies between the base 20 and the base 24 and, moreover, borders radially outer ends of the scroll ribs 22 and 24.

The first compressor body 16 is preferably supported on the carrying element 84 via outer support elements 132, which preferably engage on the base 20, apertures 134 being provided between the support elements 132, which apertures allow the refrigerant which is to be compressed to pass from the outer cooling chamber 100 into the intake region 30 in the radial direction with respect to the axis 34.

In this case, the refrigerant which is to be sucked in washes through the entire outer cooling chamber 100 and the rear-side cooling chamber 110 as a result of convection of the refrigerant which is to be sucked in assisted by pressure oscillations caused by the driven second compressor body 18, which is moving on an orbital path and which is bordered by the intake region 30 which is in communication with the outer cooling chamber 100 via the apertures 134.

As a result of this washing through the entire outer cooling chamber 100 and the rear-side cooling chamber 110, while the compressor is operating, a mean temperature which is at most 8° centigrade, preferably at most 5° centigrade, above a temperature of the refrigerant which reaches the second compressor body 18 is established in a region 111 of the rear side 112 which borders the rear-side cooling chamber 110 and lies within an annular region RB which extends over a radius from approximately 50% to approximately 80%, preferably approximately 60% to approximately 70%, of the maximum radius R of the scroll rib 22 of the first compressor body 16, so that the heat which is introduced into the first compressor body 16 can be dissipated via the rear side 112 thereof.

In this way, the first compressor body 16 can be held at a temperature which substantially corresponds to the temperature of the second compressor body 18, so that the thermal expansion of the respective base 20 or 24 and of the scroll ribs 22 or 26, respectively, is substantially identical and therefore the two compressor bodies 16 and 18 do not have any significant temperature differences which lead to uneven thermal expansion and therefore to a reduction in the seal in the region of the scroll ribs 22 and 26 and between the scroll ribs 22 and 26 and the respective bases 24 and 20.

Furthermore, in the first exemplary embodiment it is provided that the outlet 32 is disposed in the first compressor body 16, approximately coaxially with respect to the axis 34, and opens out into outlet passages 136 which pass through the mounting receiving part 116. The fact that the mounting receiving part 116 directly borders the rear-side cooling chamber 110 means that it is also possible for heat to be discharged directly from the mounting receiving part 116 into the refrigerant which is washing through the rear-side cooling chamber 110.

Furthermore, the mounting receiving part 116 is covered by a valve plate 138, which is disposed in the high-pressure chamber 120 in order to prevent the refrigerant which is under a high pressure, is flowing through the mounting receiving part 116 and enters the high-pressure chamber 120, from flowing back into the scroll compressor 14 at all times at which the pressure at the high-pressure outlet 124 is lower than in the high-pressure chamber 120.

Furthermore, in the compressor according to the invention, as illustrated in FIGS. 1 and 2, the axis 34 is located in such a way that it runs eccentrically with respect to a cylinder axis 144 of the housing 10, in order, in the region of electrical connections 137 for supplying power to the electric drive motor 12, to create a greater distance between the outer wall 74 of the housing 10 and the shield 76.

Figure 3:
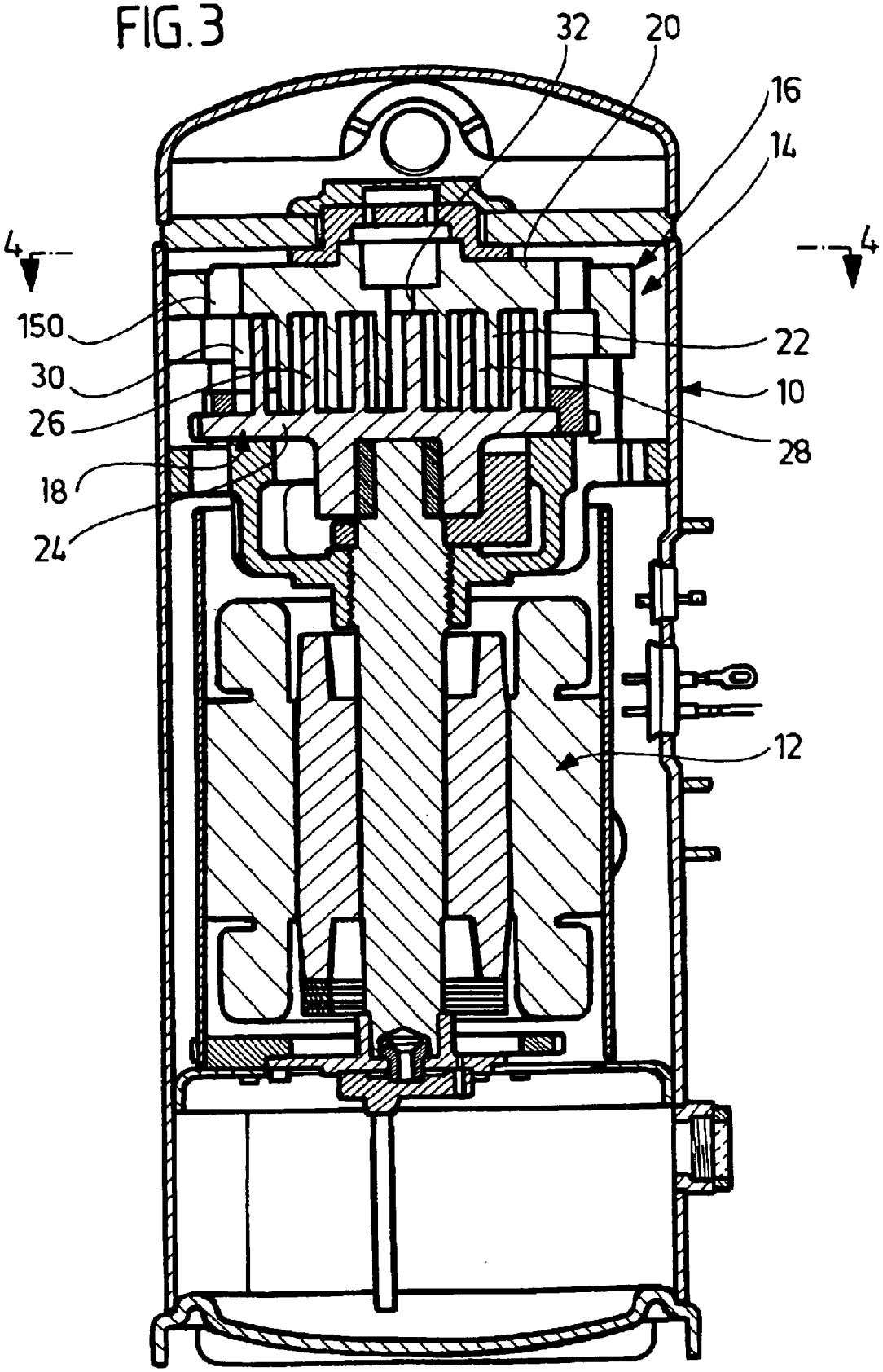
FIG. 3 shows a longitudinal section similar to that shown in FIG. 1 through a second exemplary embodiment.

In a second exemplary embodiment of the compressor according to the invention, illustrated in FIG. 3, those parts which are identical to those of the first exemplary embodiment of the compressor according to the invention are provided with the same reference numerals, and consequently for a description of these parts reference can be made entirely to the statements made in connection with the first exemplary embodiment.

Figure 4:
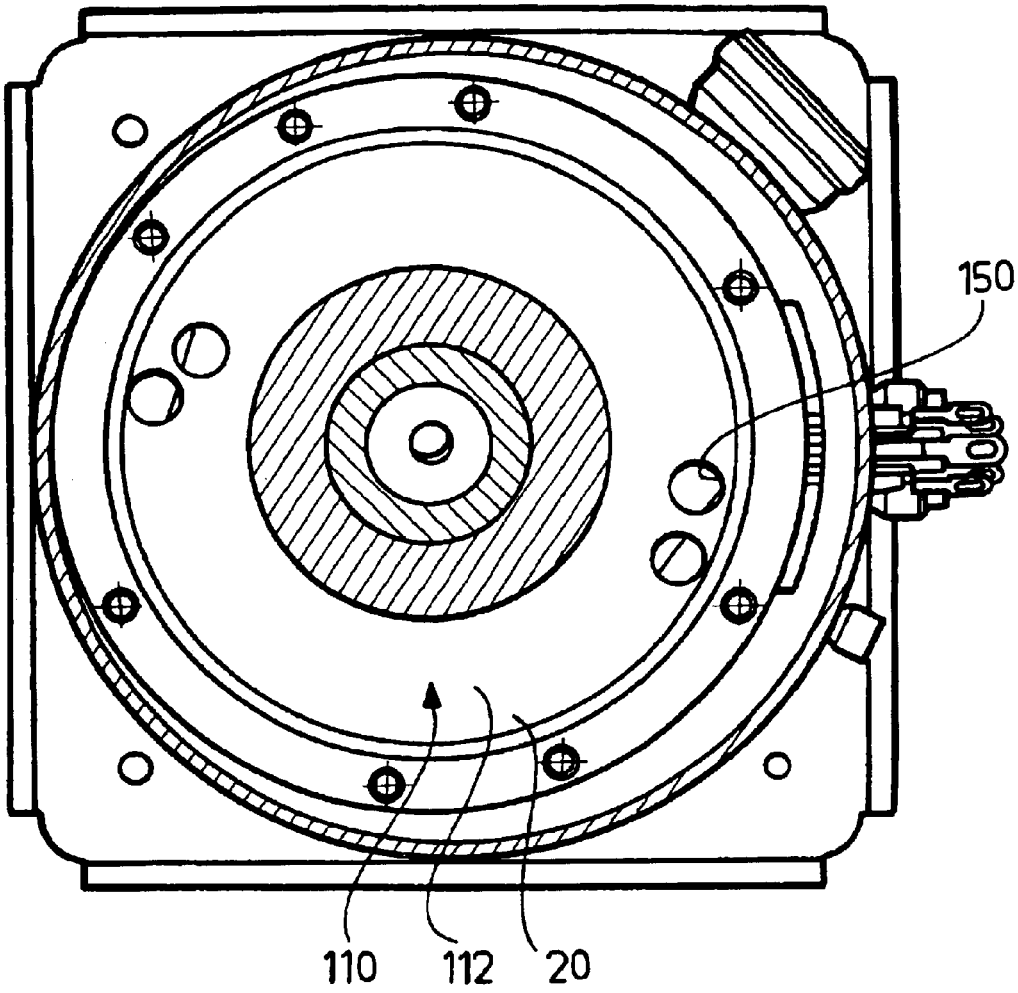
FIG. 4 shows a section on line 4—4 in FIG. 3.

In the second exemplary embodiment, illustrated in FIG. 3, unlike in the first exemplary embodiment, the base 20 of the first compressor body 16 is provided, in a sector which borders the intake region 30, with apertures 150 which, as illustrated in FIG. 4, are used to allow refrigerant which is to be compressed to flow from the rear-side cooling chamber 110 into the intake region 30 between the bases 22 and 26 and thereby to allow the refrigerant which is entering to flow with forced guidance through the rear-side cooling chamber 110 and in this way to ensure that, in the region of the rear side 112 of the base 20, optimum washing through the rear-side cooling chamber 110 and thereby optimum cooling of the first compressor body 16 is obtained.

The apertures 150 are preferably disposed in such a way that the refrigerant which is to be compressed flows from the rear-side cooling chamber 110 directly into the intake region 30 between the bases 20 and 24.

Nevertheless, in the second exemplary embodiment, refrigerant which is still to be compressed flows directly from the outer cooling chamber 100, between the bases 20 and 24, into the intake regions 30, so that only some of the refrigerant which is to be compressed enters the rear-side cooling chamber 110 with forced guidance and flows at least in part through this chamber.

Figure 6:
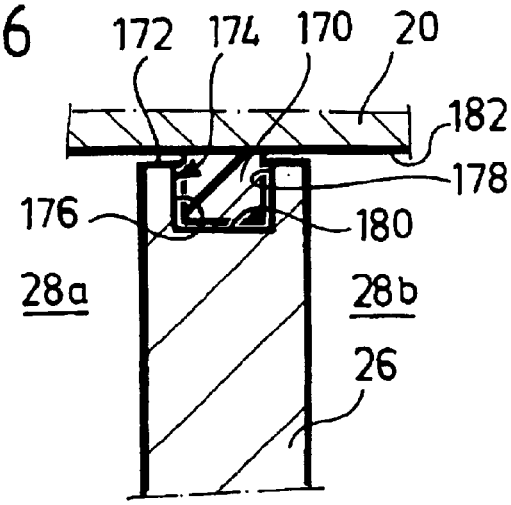
FIG. 6 shows an enlarged illustration of region A in FIG. 5.
Figure 5:
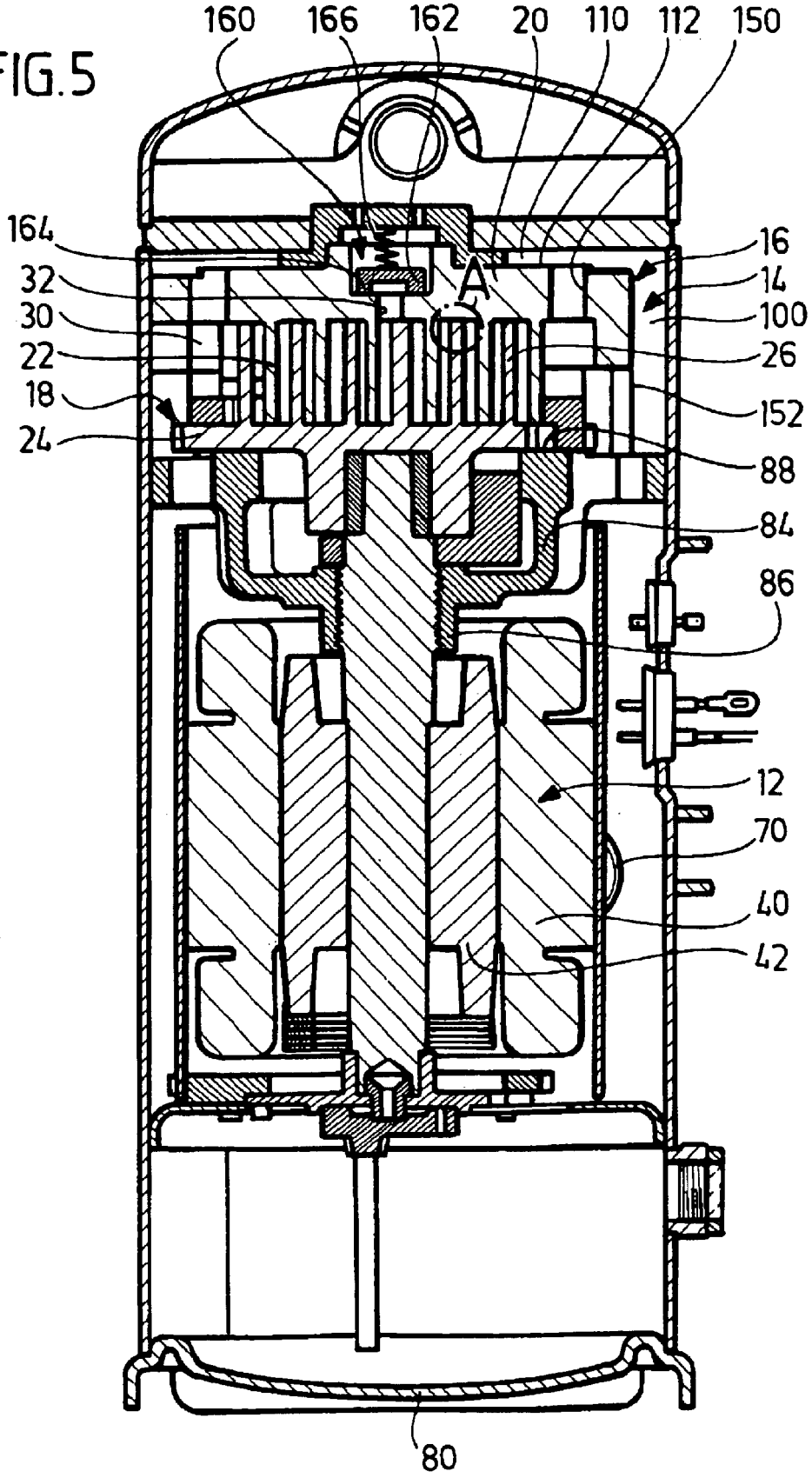
FIG. 5 shows a section similar to that shown in FIG. 3 through a third exemplary embodiment.

In a third exemplary embodiment, illustrated in FIGS. 5 and 6, those parts which are identical to the exemplary embodiments above are provided with the same reference numerals, and consequently, for explanations of these parts, reference can be made entirely to the statements which have been made in connection with the previous exemplary embodiments.

Unlike in the second exemplary embodiment, the possibility of refrigerant which is to be compressed passing from the outer cooling chamber 100 into the intake region 30 is substantially suppressed by a collar 152 which surrounds the scroll compressor 14, so that the refrigerant which is to be compressed, on its way from washing around the second compressor body 18 to washing around the first compressor body 16, flows through the outer cooling chamber 100 substantially parallel to the axis 34 and in the process cools the scroll compressor 14 on the peripheral side via the collar 152, then flows into the rear-side cooling chamber 110, flows at least partially through the latter and then enters the intake region 30 of the scroll compressor 14 via the apertures 150.

Substantially the entire stream of the refrigerant which is to be sucked in is introduced into the rear-side cooling chamber 110 and, through turbulence and/or diffusion of the refrigerant which is to be compressed, leads to the rear side 112 of the base 20 being washed around.

Therefore, the entire stream of refrigerant which is to be sucked in which flows into the intake region 30 passes at least in part through the rear-side cooling chamber 110 before this stream enters the intake region 30 through the apertures 150, so that optimum washing through the rear-side cooling chamber 110 and therefore optimum cooling of the first compressor body 16 and also of the mounting receiving part 116 takes place in the same way as for the second compressor body 18 through additional diffusion or also turbulent flows which form, so that both compressor bodies 16 and 18 preferably form the same temperature profile and therefore it is possible to optimize the temperature control of the two compressor bodies 16 and 18, which contributes to improving the sealing of the scroll compressor 14 during operation.

In the third exemplary embodiment, moreover, a nonreturn valve 160 with a valve body 162 is disposed in the first compressor body 16. For this purpose, a valve seat face 164 directly borders the outlet 32 as ring face on which the valve body 162 can be fitted in a tightly sealing fashion.

Furthermore, the valve body 162 is loaded toward the valve seat face 164 by means of a spring 166 and is therefore only lifted off the valve seat face 164 by the compressed refrigerant flowing out of the outlet 32.

The advantage of this nonreturn valve 160 is that it can be arranged as close as possible to the outlet 32 without a large harmful volume.

Furthermore, in the third exemplary embodiment, as illustrated in FIG. 6, each of the scroll ribs, illustrated by way of example for scroll rib 26, is provided with an end-side seal 170 which is inserted into a groove 174 which has been machined into an end side 172 of the respective scroll rib 26 and comprises two lateral groove walls 176 and 178 and a groove base 180, the dimensions of the end-side seal 170 being such that it can move inside the groove 174 and therefore can be acted on in the direction of a base surface 182 of the base 20 of in each case the other compressor body.

It is therefore possible, starting from the chamber 28*a* which is under higher pressure, for the refrigerant which is to be compressed to act upon the end-side seal in such a way that the seal comes off the side wall 176 which faces the chamber 28*a* which is under a higher pressure and comes to bear against the side wall 178 which faces the chamber 28*b* which is under a lower pressure. The refrigerant which is under a higher pressure flows onward to the groove base 180 and therefore leads to the end-side seal 170 lifting off the groove base 180 and being moved toward the base surface 182 by the refrigerant which is under higher pressure, thereby being held in contact therewith.

In this way, it is advantageously possible to improve the seal between the individual scroll ribs 26 and the base surfaces 182 of in each case the other compressor body 20, and thereby, moreover, to additionally increase the efficiency of the scroll compressor 14.

It is particularly advantageous if the end-side seals 170 are produced from a plastics material like flouropolymer resins preferably Teflon®, in particular a Teflon® compound containing 5% to 20% of carbon or other strength-improving additives.

What is claimed is:

1. A compressor for refrigerant, comprising:

a housing;

a scroll compressor, which is disposed in the housing and has a first compressor body, which is disposed in a stationary position in the housing, and a second compressor body, which can move relative to the first compressor body, each of these bodies having a base and respective first and second scroll ribs, which rise above the respective base and engage in one another in such a way that, during compression of the refrigerant, the second compressor body can be moved along an orbital path about a center axis with respect to the first compressor body, a drive for the second compressor body, having a drive motor, a rear-side cooling chamber, arranged between the rear side of the first compressor body and a partition of the housing which is spaced from the rear side, and at least one aperture in the base of the first compressor body enabling refrigerant which is to be sucked into an intake region of the scroll compressor to flow at least in part through the rear side cooling chamber and then flow from the rear side cooling chamber through the at least one aperture in the base of the first compressor body in order to cool the first compressor body in the region of the rear side, the second compressor body being adapted to enable the refrigerant which is to be compressed by the scroll compressor to wash around the second compressor body, so that the second compressor body can be cooled.

2. The compressor according to claim 1, wherein substantially all the refrigerant which is to be compressed can wash around the first compressor body in the region of the rear side, which is remote from the first scroll rib.

3. The compressor according to claim 1, wherein the rear surface of the respective compressor body is formed directly by a base which carries the respective scroll rib.

4. The compressor according to claim 1, wherein both compressor bodies can be cooled by the refrigerant which is to be compressed in the region of a peripheral side which is on the outer side with respect to the center axis.

5. The compressor according to claim 1, wherein the refrigerant which is to be compressed can wash around the first compressor body in the region of its rear side which lies outside a high-pressure connection.

6. The compressor according to claim 1, wherein the rear-side cooling chamber surrounds a mounting receiving part which extends to the first compressor body.

7. The compressor according to claim 6, wherein the rear-side cooling chamber runs in the form of a ring around the mounting receiving part for the first compressor body.

8. The compressor according to claim 1, wherein the partition delimits a high-pressure chamber of the compressor.

9. The compressor according to claim 1, wherein the rear-side cooling chamber merges into a peripheral-side cooling chamber which surrounds an outer periphery of the first compressor body.

10. The compressor according to claim 1, wherein the first compressor body is supported by outer support elements which lie radially outside the scroll ribs with respect to the center axis.

11. The compressor according to claim 10, wherein a peripheral-side cooling chamber runs around the outer support elements.

12. The compressor according to claim 1, wherein the temperature of the rear side of the first compressor body, which borders the refrigerant which is to be compressed in the rear-side cooling chamber, within an annular region (RB) which lies between approximately 50% and approximately 80% of a maximum radius of the scroll ribs, is at most 8° centigrade higher than the temperature of the refrigerant which is to be compressed and reaches the second compressor body.

13. The compressor according to claim 1, wherein the refrigerant which is to be compressed washes around the second compressor body first of all and then around the first compressor body.

14. The compressor according to claim 1, wherein the refrigerant which is used to cool the compressor bodies is the refrigerant which is to be sucked in by the scroll compressor.

15. The compressor according to claim 14, wherein the refrigerant which is to be sucked in cools the compressor bodies substantially immediately before it enters an intake region of the scroll compressor.

16. The compressor according to claim 14, wherein the refrigerant which is to be sucked in flows into the intake region of the scroll compressor at least in part from a peripheral side of the scroll compressor between the base of the first compressor body and the base of the second compressor body.

17. The compressor according to claim 16, wherein the refrigerant which is to be sucked in flows into the intake region of the scroll compressor at least partially radially with respect to the center axis between the bases of the compressor bodies.

18. The compressor according to claim 1, wherein the refrigerant which is to be compressed, at least in the form of a part-stream, flows with forced guidance through the rear-side cooling chamber.

19. The compressor according to claim 1, wherein all the refrigerant which is to be sucked in flows into the intake region of the scroll compressor through the rear-side cooling chamber and then through the at least one aperture in the base of the first compressor body.

20. The compressor according to claim 1, wherein the refrigerant which is to be compressed cools the drive motor and the scroll compressor.

21. The compressor according to claim 20, wherein the refrigerant which is to be compressed cools the drive motor first of all and then cools the scroll compressor.

22. The compressor according to claim 21, wherein the refrigerant which is to be compressed flows through the drive motor on the rotor side.

23. The compressor according to claim 21, wherein the refrigerant which is to be compressed flows around the drive motor on the peripheral side.

24. The compressor according to claim 21, wherein the refrigerant which is to be compressed first of all flows around the second compressor body and then enters the intake region of the scroll compressor.

25. The compressor according to claim 1, wherein the scroll ribs of one compressor body, on their end sides which face the base of the other compressor body, carry end-side seals which are fitted into grooves.

26. The compressor according to claim 25, wherein the end-side seals can move in the grooves, in the direction of the base of the other compressor body.

27. The compressor according to claim 26, wherein the end-side seals, under the action of the higher pressure in each case in the scroll compressor, can be moved in the direction of the base of in each case the other compressor body.

28. The compressor according to claim 25, wherein the end-side seals are made from plastics.

29. The compressor according to claim 28, wherein the end-side seals comprise flouropolymer resin as the main constituent.

30. The compressor according to claim 1, wherein a nonreturn valve is associated with the high-pressure outlet.

31. The compressor according to claim 30, wherein the nonreturn valve has a seal seat which is located in the first compressor body.

32. The compressor according to claim 30, wherein the nonreturn valve is disposed in a high-pressure chamber on a side of the partition which lies opposite the first compressor body.

33. The compressor according to claim 1, wherein refrigerant which is to be compressed flows along the way from washing around the second compressor body to washing around the first compressor body through an outer cooling chamber surrounding the scroll compressor on a radially outer side and is surrounded by the housing.

34. The compressor according to claim 1, wherein a collar is provided surrounding the scroll compressor, said collar substantially suppressing refrigerant which is to be compressed passing into the intake region of said scroll compressor from an outer cooling chamber surrounding the scroll compressor on a radially outer side and being surrounded by the housing.

35. The compressor according to claim 1, wherein the second compressor body is adapted to enable the refrigerant which is to be compressed by the scroll compressor to wash around the second compressor body in the region of the rear side which is remote from the scroll ribs, so that the second compressor body can be cooled.

36. The compressor according to claim 35, wherein the refrigerant which is to be compressed can wash around the second compressor body in the region of the rear side, which is disposed opposite the second scroll rib, radially outside its driver receiving part.

* * * * *